United States Patent [19]

Bolli

[11] Patent Number: 4,556,393

[45] Date of Patent: Dec. 3, 1985

[54] TOY BUILDING BLOCK WITH ELECTRICAL CONTACTS

[75] Inventor: Peter Bolli, Steinhausen, Switzerland

[73] Assignee: Interlego AG, Baar, Switzerland

[21] Appl. No.: 578,262

[22] Filed: Feb. 8, 1984

[30] Foreign Application Priority Data

Feb. 14, 1983 [CH] Switzerland ..... 815/83

[51] Int. Cl.[4] ..... A63H 33/04

[52] U.S. Cl. ..... 446/91; 446/128; 446/484

[58] Field of Search ..... 446/91, 90, 484, 128, 446/124, 125; 200/307

[56] References Cited

U.S. PATENT DOCUMENTS

| | | | |
|---|---|---|---|
| 3,005,282 | 10/1961 | Christiansen | 446/128 |
| 3,237,341 | 3/1966 | Janning | 446/91 |
| 3,447,249 | 6/1969 | Greger | 446/91 |
| 3,484,984 | 12/1969 | Fischer | 446/91 |
| 3,696,548 | 10/1972 | Teller | 446/91 |
| 4,423,465 | 12/1983 | Teng-Ching et al. | 200/307 |

FOREIGN PATENT DOCUMENTS

| | | | |
|---|---|---|---|
| 2552587 | 5/1977 | Fed. Rep. of Germany | 446/91 |
| 455606 | 7/1968 | Switzerland | 446/91 |

*Primary Examiner*—Robert A. Hafer
*Assistant Examiner*—Daniel Nolan
*Attorney, Agent, or Firm*—Kane, Dalsimer, Kane, Sullivan and Kurucz

[57] ABSTRACT

A building block having side walls and a front face perpendicular to these is provided with two rows of coupling pins on one side of the front face and counter-coupling tubes on the other side for mechanically coupling two building blocks by means of a clamping action. In each row, each second coupling pin has an electrically conducting surface, while the coupling pins lying between these are electrically insulating. One row of conducting pins is displaced in the direction of the rows by one coupling pin from the adjacent row. On the other side of the front wall a contact bar is arranged which is connected electrically with the conducting coupling pins of an associated row. The bar has a contact area for producing electrical contact with a row of conducting coupling pins of an adjacent, coupled building block.

12 Claims, 22 Drawing Figures

TOY BUILDING BLOCK WITH ELECTRICAL CONTACTS

BACKGROUND OF THE INVENTION

The present invention relates to a building block for construction sets and especially to toy building blocks capable of joining with other similar blocks to form electrical circuits.

In U.S. Pat. No. 3,005,282 there is disclosed a building block in which a top face is provided on its one side with at least one row of coupling pins and on its other side with counter-coupling sockets for connection with the coupling pins of an adjacent similar building block. Such blocks are widely sold under the trade names "LEGO" and "DUPLO". It is furthermore known from Swiss Pat. No. 455,606 that at least some of the coupling pins may have electrically conducting surfaces or that the side of the face provided with counter-coupling sockets may have electrically conducting connectors intended to establish electrical contact with the conducting surfaces of an adjacent, coupled building block, when the two building blocks are coupled together mechanically.

These known building blocks for constructing electrical circuits are expensive to manufacture, cannot be used universally with other building blocks of the same building block system and require the user to have at least an elementary knowledge of electrotechnology with respect to circuit diagrams.

In German patent application No. 2,552,587, a clamping building block with possibilities for electrical connections is disclosed, in which an electrical connection is produced at the places of contact between elevations and depressions of the building block by connecting contact sites mounted at these places. In this system special attention has to be given to avoid a short circuit when connections are made. How the contacting sites are mounted is not explained in the patent.

It is an object of the present invention to provide a building block of the aforementioned type, having electrical contacting means.

A further object is to provide such a block in which the coupling pins and counter-coupling sockets may be combined at will with conventional blocks of the same block system which are provided without contacting means and the contact-making ability.

A still further object is to provide such a block capable of forming short-circuit-proof electrical connection between bipolar circuits.

The development of the building block of the present invention prevents short circuiting between the circuits associated with different row of coupling pins of two building blocks, when two similar building blocks are coupled together. This is so even when the blocks are perpendicular to each other. The blocks may thus be assembled without any special precautionary measures and without electrotechnical knowledge on the part of the user.

SUMMARY OF THE INVENTION

The above and other beneficial objects are attained in accordance with the present invention by providing a building block having a top face one side of which is provided with coupling pins. Every second coupling pin has an electrically conducting surface whereby the electrically conducting coupling pins of one row are displaced from those of a different row. A contact bar is arranged on the other side of the face for each row of coupling pins. The contact bar extends in the direction of the rows, is connected electrically with the conducting surfaces of the coupling pins and has electrically conducting areas, which are formed in order to be in electrical contact with the contacting surfaces of a row of coupling pins of an adjacent coupled building block.

The building block can also be formed in such a way that in at least one section of each row all consecutive coupling pins have electrically conducting surfaces and are connected electrically to each other and that a contacting element is arranged on the other side of the wall for each row of coupling pins at the place of each second coupling pin. The contacting element being connected electrically to the conducting surfaces of the coupling pins of the row and having an electrically conducting area which is formed to be in electrical contact with the conducting surface. The contact elements connected with one row of coupling pins is displaced in the direction of the rows relative to the contact elements connected with a different row of coupling pins.

The contact bar for the first-mentioned embodiment of the invention can be arranged either along each of the two parallel side walls of the hollow body or on both sides of and along a central line, which is equidistant from two parallel side wall of the hollow body. By means of these two variations, it is possible to provide contact bars in building blocks of practically any type of coupling arrangement.

DETAILED DESCRIPTION OF THE PREFERRED EMBODIMENTS

Figure 1:
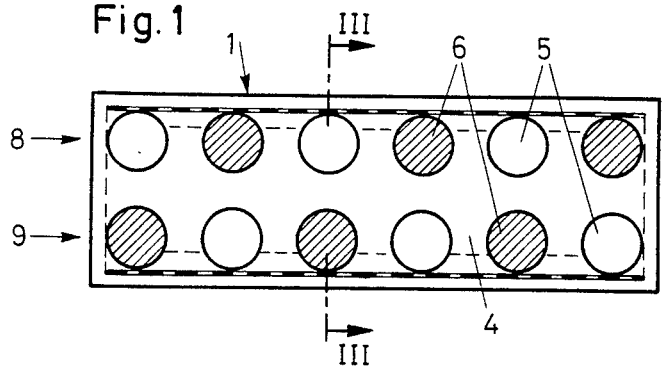
FIG. 1 is a top plan view of the front face of a building block with two rows of six coupling pins each, some of which have electrically conducting side faces.
Figure 2:
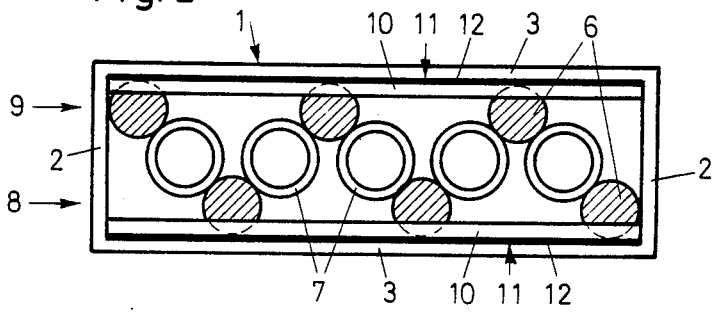
FIG. 2 is a plan view of the underside of the component of FIG. 1 with contact bars.
Figure 3:
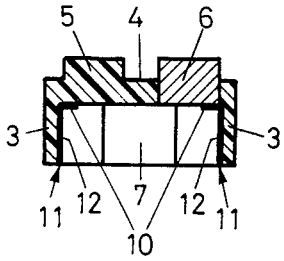
FIG. 3 is a sectional view taken along the line III—III in FIG. 1.

Reference is now made to the drawings and to FIGS. 1 to 3 in particular wherein a building block generally of the type shown in U.S. Pat. No. 3,005,282 is shown comprising a box-shaped hollow body 1, formed of an electrically insulating plastic material, with end walls 2, side walls 3 and a front wall 4, which is perpendicular to the end and side walls. On the external side of front wall 4 the building block has cylindrical coupling pins 5 or 6. In the interior of hollow body 1 counter-coupling sockets are provided in the form of tubes 7 projecting into the hollow body 1.

In the first embodiment, the building block has two rows 8 and 9 of six coupling pins 5 or 6, which are arranged in pairs next to each other, as well as five counter-coupling tubes 7. When two building blocks as shown in FIGS. 1 to 3, (or equivalent blocks of different lengths) are coupled together, the coupling pins 5 and 6 of the one building block are wedged in the overlapping sections of the two building blocks between two counter-coupling tubes 7 and a side wall 3 or between a counter-coupling tube 7, a side wall 3 and an end wall 2. This action provides a stable, but detachable, mechanical type of connection.

In accordance with the present invention, in the embodiment of FIGS. 1 to 3, each second coupling pin 6 of each row 8, 9 has electrically conducting surfaces. This is attained by forming the pins of a metal. This is indicated on the front faces of FIGS. 1 and 2 by hatching. The coupling pins 5, lying in between the metalic pins, are formed completely from the plastic insulating material of hollow body 1. The conducting coupling pins 6 of the one row 8 are displaced by one coupling pin in the longitudinal direction of hollow body 1 from those of row 9.

As can be seen from FIGS. 2 and 3, each conducting coupling pin 6 of both rows 8 and 9 penetrate the bottom wall of 4 and lie against one leg 10 of a metallic strap 11. Strap 11 has an L-shaped cross section. These coupling pins 6 are connected mechanically and electrically, e.g. soldered, with leg 10, so that all conducting coupling pins 6 of the same row are connected electrically to one another. The other leg 12 of L strap 11 lies against the one or the other side wall 3 of hollow body 1 and forms a contact strip with a longitudinal conducting area along the side wall 3 in question. The straps 11 extend within the interior of the hollow body form end to end as shown.

It can be seen that when two building blocks of the type described are placed on top of one another and coupled, whether so as to overlap completely in the longitudinal direction or only partly, the side faces of the conducting coupling pins 6 of the one row 8 of a building block make electrical contact with one contact strip 12 of the other building block. This is also the case for the conducting coupling pins 6 of the other row 9 and the other contact strip 12. As a result, the circuits associated with row 8 and row 9 are maintained and remain separate from each other. The same applies if the blocks are joined at right angles as is explained below with reference to FIGS. 4 and 5.

Figure 4:
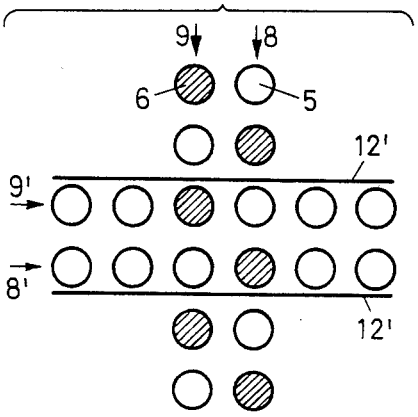
FIG. 4 is a schematic representation of two building blocks of FIGS. 1 to 3, which are coupled together at right angles to each other.
Figure 5:
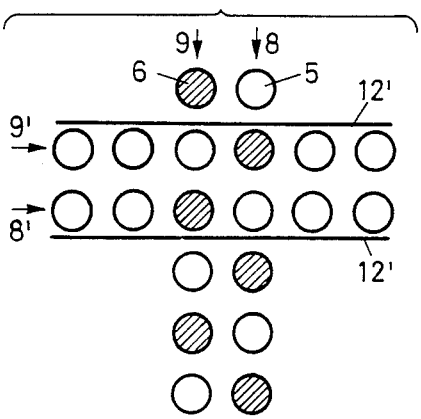
FIG. 5 is a schematic representation similar to FIG. 4 with one building block, which is displaced relative to that of FIG. 4.

According to FIGS. 4 and 5, a second building block with the rows 8′ and 9′ of coupling pins is placed on and perpendicularly to a first building block with rows 8 and 9 of coupling pins. In this case, the insulating coupling pins 5 of the first building block are indicated by empty circles and the conducting coupling 6 of the first building block by filled circles. The coupling pins of the second building block, (which have no effect on the electrical contact-making under consideration here), are indicated by empty circles. Similarly, only the two contact strips 12′ of the second building block are involved in establishing the desired connection.

In the arrangement of FIG. 4, a conducting coupling pin 6 of row 8 of the first building block makes electrical contact with contact strip 12′ of row 8′ of the second building block. The same is the case for rows 9 and 9′. Accordingly, all coupling pins 6 of the one row 8 of the first building block are electrically connected with all coupling pins 6′ of the one row 8′ of the other building block. Similarly, all coupling pins 6 of the other row 9 of the first building block are electrically connected with all coupling pins 6′ of the other row 9′ of the other building block. There can be no cross connection, that is, no short circuit from the one row 8 or 8′ to the other row 9 or 9′. This alignment of connections remains unchanged even if the second building block (i.e. with rows 8′, 9′) is displaced longitudinally when placed on the first building block. (i.e. with rows 8, 9).

If, as shown in FIG. 5, the second building black (rows 8′, 9′,) is shifted one pin upwardly, the short-circuit-proof connection continues to be maintained between the rows 8, 9 and 8′ 9′ however, polarity inversion takes place, since row 8 is now connected with row 9′ and row 9 with row 8′.

Figure 6:
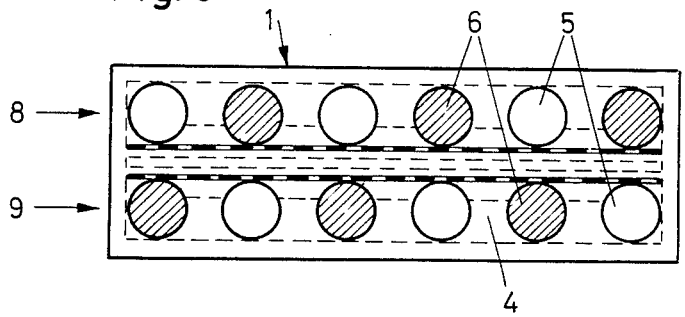
FIG. 6 is a top plan view of the top face of another embodiment of a building block with two rows of six coupling pins each.
Figure 7:
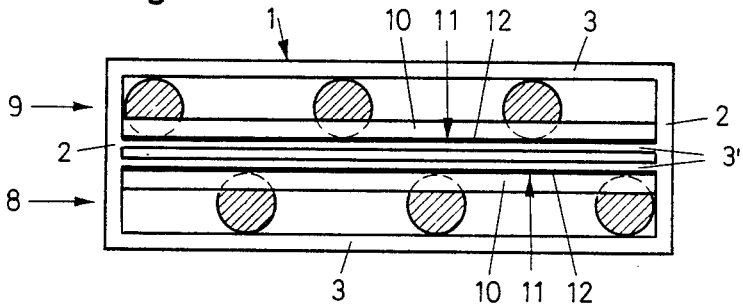
FIG. 7 is a plan view of the underside of the building block of FIG. 6.

A further embodiment of the present invention is shown by the building block in FIGS. 6 and 7, whose hollow body 1 differs from that of the embodiment of FIGS. 1 and 2 in that in the interior of its hollow body there are two parallel, longitudinal walls 3′. Walls 3′ are formed at the interior face of wall 4 and extend to the end walls 2. Walls 3′ serve as part of the counter-coupling sockets for coupling pins 5 and 6 which are present in two rows 8 and 9. In this case, the L straps 11 are arranged in such a way that contact strips 12 extend along the parallel walls 3′. One leg 10 of strap 11 connects with the conductive coupling pins 6. The other leg 12 acts as a contact strip for the conducting pins of an adjacent block to be coupled with it. In other words, contact strips 12 are arranged electrically separately from each other on both sides of and along a central line, which is equidistant from the two parallel side walls of hollow body 1.

Instead of providing metallic coupling pins 6, conventional insulating pins can be equipped with a sleeve-shaped metalic casing. In this case, the L strap 11 is replaced by a strap-shaped contact strip (corresponding to leg 12 of L strap 11,) in the interior of hollow body 1 and connected to the sleeve-shaped casing of the associated row. Instead of a closed sleeve, which can be produced by deep drawing, a longitudinally slit sleeve can be provided. In this case, the sleeves and the corresponding contact strips can be produced in one piece from a sheet-metal strip by stamping and bending. The conducting coupling pins as well as the contact strips described can be adapted in respect to shape in a simple manner to the particular construction of the insulating coupling pins and counter-coupling sockets of practically all building block systems.

Figure 8:
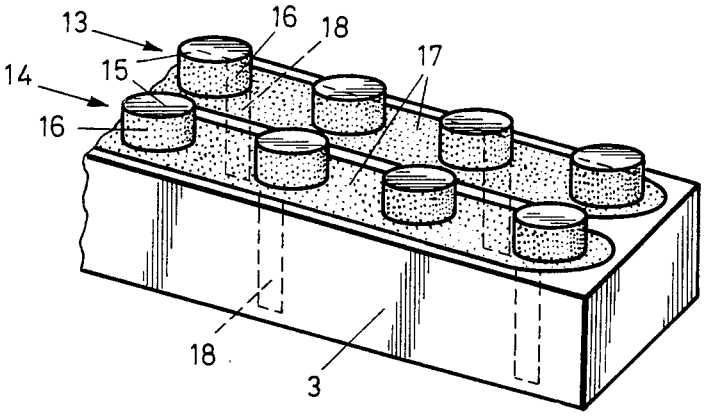
FIG. 8 is a perspective view of the front face of a building block of a further embodiment, in which all coupling pins have electrically conducting surfaces and are connected to each other, but on the opposite side of which, separate, laminar contacting elements are arranged.

FIG. 8 shows a perspective view of a toy building block which forms the reverse of the construction of the contact arrangement of FIGS. 1 and 2. The building block of FIG. 8 has two rows 13 and 14 of coupling pins 15. In contrast to the embodiment of FIGS. 1 and 2 however, all coupling pins 15 have electrically conducting side faces 16. Moreover, all coupling pins 15 of the same row 13 or 14 are connected electrically to each other by means of a metallic strip 17.

On the other hand, instead of a contact bar 11 for each row, (as in FIG. 2), individual, separate, laminar contact elements 18 are arranged in the interior of the building block. These are represented by broken lines in FIG. 8. Each contact element 18 extends from the respective metallic connecting strip 17, with which it is connected electrically, along the side wall 3 in question up to the lower edge of side wall 3. A contacting element 18 is provided only at the place of each second coupling pin 15 of each row 13, 14. Moreover, the contacting elements 18 of the one row 13 are displaced by one coupling pin relative to those of the other row 14.

It is evident that when two similar building blocks of this type are coupled together, electrical connections are produced in the same manner and without risk of causing a short circuit, in the same manner as was already explained with reference to FIGS. 4 and 5.

The conducting surfaces of the coupling pins, as well as the contact bars of the contacting devices described, especially those of FIGS. 1, 2, 6 and 7, can be adapted with relative ease to the pin and socket arrangement of the building blocks of practically all known systems. This will be explained briefly below by means of the schematic overviews shown in FIGS. 9 to 19. In these views the participating contacting devices of the two building blocks coupled perpendicularly to each other, are shown in the same way as those of FIG. 4. FIGS. 10, 12, 14, 16 and 18 in each case show contact bars, which are arranged essentially along the two side walls of the building blocks. FIGS. 9, 11, 13, 15, 17 and 19, depict building blocks in which the contact bars are arranged on both sides of a central line of the building block.

Figure 9:
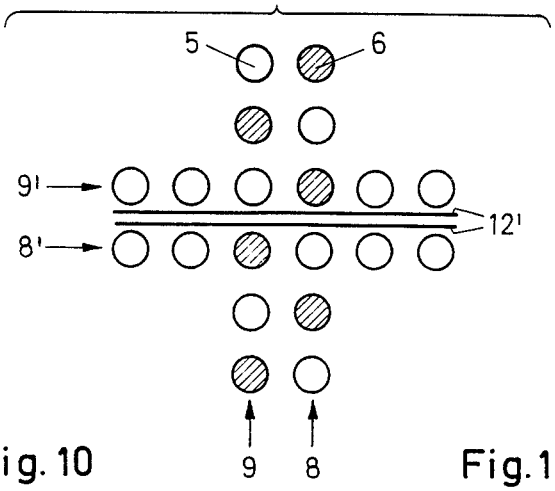
FIGS. 9 to FIG. 19 show schematic representations of the coupling at right angles of a pair of building blocks.

FIG. 9 shows the contact made when two building blocks of FIGS. 6 and 7 are coupled together, rows 8 and 9 of insulating and conducting coupling pins 5 and 6 of the one building block, as well as contact bars 12' of rows 8' and 9' of the other building block being numbered in agreement with FIG. 4. Here also, it can be seen that a short-circuit-proof allocation of electrical connections is achieved.

Figure 10:
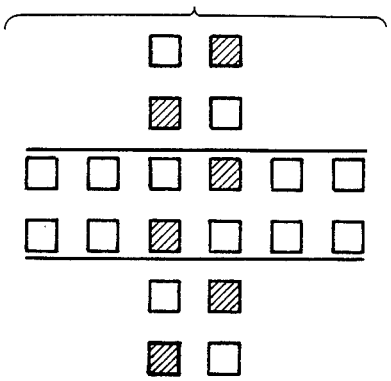
Figure 11:
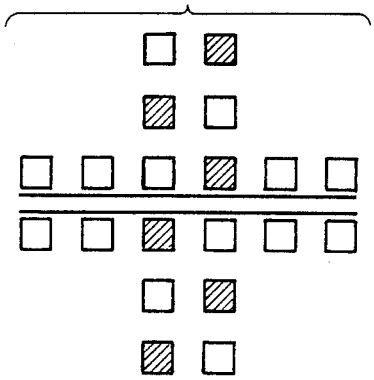
Figure 12:
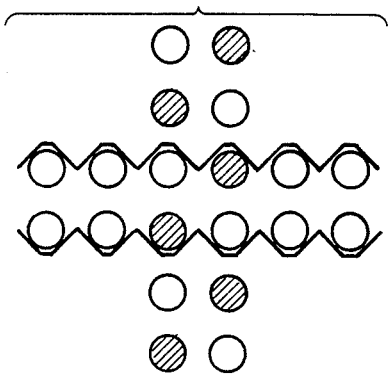
Figure 13:
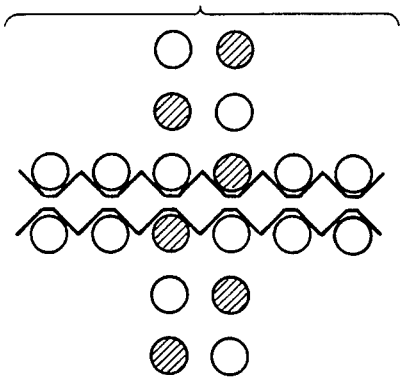
Figure 14:
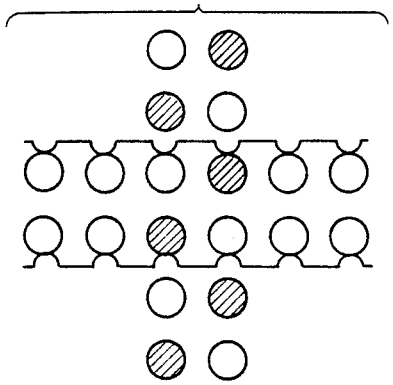
Figure 15:
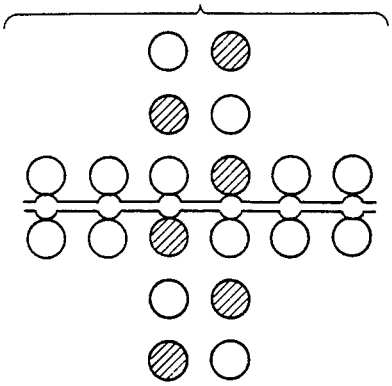
Figure 16:
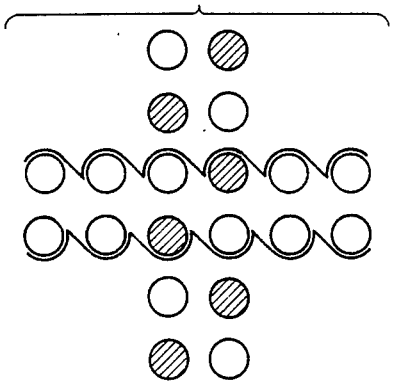
Figure 17:
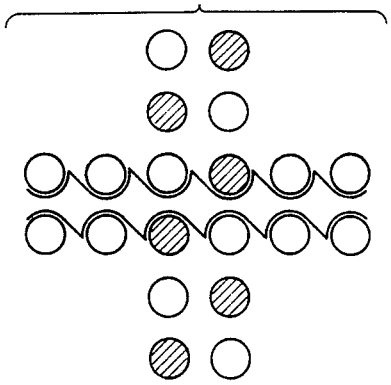
Figure 18:
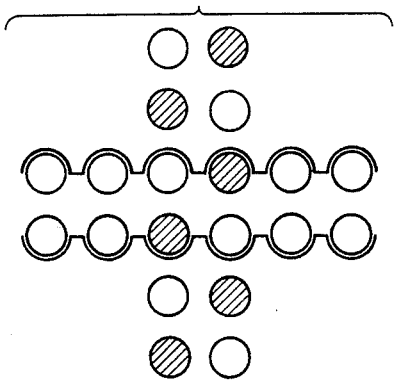
Figure 19:
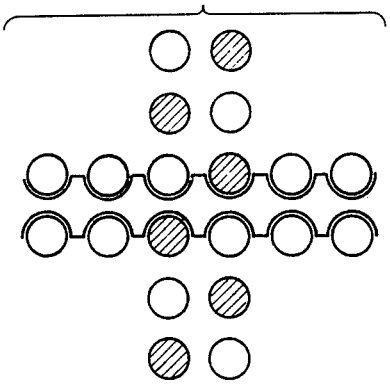

Toy building blocks are known which have square coupling pins rather than cylindrical ones. Contacting devices of the present invention can also be arranged for these building blocks, as is shown in FIGS. 10 and 11.

The other arrangements of contacting devices, which are shown in FIGS. 11 to 19, make use of contact bars, which are bent repeatedly. This is done to accommodate the coupling arrangement of the building blocks in question. Thus, if in place of the counter-coupling tubes of FIG. 2, relatively thin pins formed in larger numbers and which can be solid or slit, are used for coupling, one of the contact bar arrangements of FIGS. 11 and 19 may have to be used.

Figure 20:
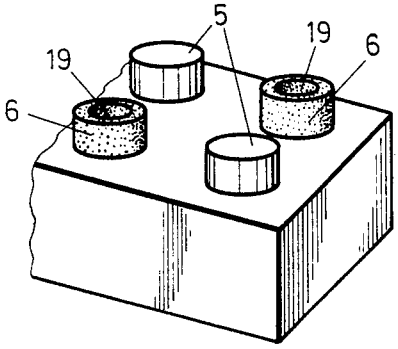
FIG. 20 is a partial perspective view of the front face of a section of the building block of FIG. 1, in which the conducting coupling pins are developed as contact sockets.

A toy building block in the manner of the building block of FIG. 1 is partially shown in FIG. 20. In this building block, the metallic coupling pins 6, which are arranged in rows alternately with the insulating coupling pins 5, have a central borehole 19, into which a plug pin can be introduced for suppling electric current to or withdrawing electric current from the building block.

Figure 21:
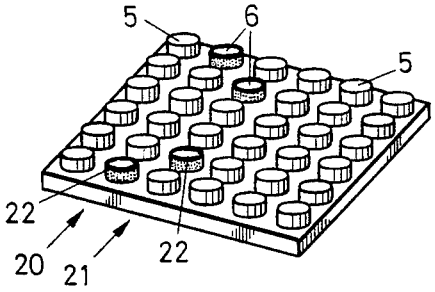
FIG. 21 is a perspective view of the front face of a plate-shaped building block having more than two rows of coupling pins.

The present invention may also be incorporated into a plate-like building blocks having a larger number of rows of coupling pins in order to supply current to or withdraw current. A building block of this type, which has several rows of insulating coupling pins 5 lying next to each other is shown as an Example in FIG. 21. In two adjacent rows 20 and 21, the two coupling pins 6 at the edge or the next coupling pins inwards are provided with conducting surfaces 22. In the building block shown, the conducting surfaces 22 of coupling pins 6 of each row 20, 21 are connected electrically to each other through contact strips, which are arranged on the hollow underside of the building block and which are not shown.

A similar flat building block with a relatively large area can also be provided as a base plate. At certain places, especially adjacent to the edges of the base plate as in building block of FIG. 21, has electrically conducting coupling pins, are provided which are arranged in pairs and offset. The pairs at each end are linked for bipolar connections. Building blocks such as disclosed in FIGS. 1 to 9, are then used as connecting elements in order to supply bipolar current to the base plate from a source of current or to withdraw bipolar current from the base plate for a consuming device, e.g. a lamp.

Figure 22:
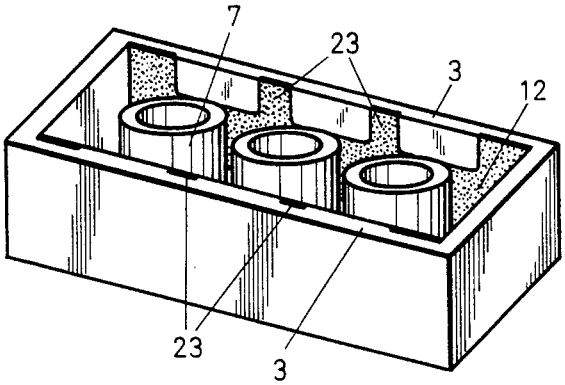
FIGS. 22 is a perspective view of the underside of a building block similar to that of FIG. 2, in which the contact bars are resiliently formed.

Although normally a sufficient contact pressure is produced automatically as a result of the naturally elastic side walls of the building block, the underside of a building block with counter-coupling tubes 7 is shown in FIG. 22 may be provided with resilient conducting contact strips 12. To this end, the contact strips extend as fingers 23 over the complete height of the side walls 3. The fingers 23 are provided only at the contact sites. The fingers 23 provide a resilient electrical contact with the coupling pins of an associated building block.

The building blocks of the present invention may be coupled readily with conventional blocks when their circuit making capacity is not needed. Further, the electric circuits which may be produced are virtually problem free. The use of the blocks requires little or no instructions or special training and there is no risk of causing short circuits.

I claim:

1. A toy building block having on one face thereof at least two parallel rows of coupling pins thereon and on the opposite side of said face counter-coupling sockets for mechanical engagement with the coupling pins of another similar block, the coupling pins of said two rows being arranged in adjacent pairs, means for making electrical contact with select ones of the coupling pins of each row, the select pins of each row being longitudinally displaced from the select pins of the other row and said means includes portions adapted to make electrical contact with the selected pins of another similar block.

2. The building block in accordance with claim 1 wherein in at least a part of each row of coupling pins every second coupling pin has an electrically conducting surface, the electrically conducting coupling pins of the one row being displaced longitudinally from the electrically conducting coupling pins of the other row.

3. The building block in accordance with claim 2 wherein said contact means includes a bar associated with each row extending in the longitudinal direction of said rows and disposed on the opposite side of said face, each of said bars including conducting areas forming at least a portion of the counter-coupling socket whereby when a similar block is mechanically coupled with said block said bars makes electrical contact with the conducting pins of said similar block.

4. The building block in accordance with claim 1 wherein in at least a part of each row all consecutive coupling pins have electrically conducting surfaces and are electrically connected to the other pins of said row and wherein said contact means comprises elongated contact elements associated with each row disposed on the opposite side of said face and making electrical contact with alternate ones of said coupling pins of an associated row, the contacted pins of one row being displaced from the contacted pins of the other row.

5. The building block in accordance with claim 1, 2 or 4 wherein the magnitude of the displacement is equal to the distance between two coupling pins in the direction of the rows.

6. The building block in accordance with claim 3 wherein said block includes two parallel side walls which extend parallel to the rows of coupling pins and wherein said bars extend along said side walls.

7. The building block in accordance with claim 3 wherein said block includes two parallel side walls which extend parallel to said rows of coupling pins and wherein said bars extend on both sides along a center line which is equidistant from the two side walls.

8. The building block in accordance with claim 4 wherein said block includes two parallel side walls which extend parallel to said rows of coupling pins and wherein said contact elements are disposed along said side walls.

9. The building block in accordance with claim 4 wherein said block includes two parallel side walls which extend parallel to said rows of coupling pins and wherein said contact elements extend on both sides along a center line which is equidistant front the two side walls.

10. The building block in accordance with claim 3 wherein the coupling pins with conductive surfaces are formed as metalic pins which penetrate through said face, and said contact means includes two straps each having an L-cross section defined by a pair of legs, one leg of each strap is positioned to engage the metalic pins of an associated row of that block and the other leg of each strap is adapted to engage the pins of a similar block mechanically coupled to the block.

11. The building block in accordance with claim 3 wherein the coupling pins with conductive surfaces comprise insulated pins over which a conductive sleeve is positioned, the conductive sleeves of the same row being connected.

12. The building block in accordance with claims 1,2,3,4,6,7,8,9,10, or 11 wherein at least some of said selected coupling pins have a central borehole extending therein, said borehole being provided with a conductive inner surface, said inner surface being in electrical contact with said means for making electrical contact, whereby a plug pin may be introduced into said borehole to bring current to or withdraw current from said building block.

* * * * *